United States Patent [19]

Nakazato et al.

[11] Patent Number: 5,035,644

[45] Date of Patent: Jul. 30, 1991

[54] PROPER COUPLING CONFIRMING MECHANISM FOR AN ELECTRIC CONNECTOR

[75] Inventors: Wataru Nakazato; Kunihiko Muraoka, both of Ohta; Shigemitsu Inaba, Shizuoka; Kazuto Ohtaka, Shizuoka; Takashi Takagishi, Shizuoka, all of Japan

[73] Assignees: Yazaki Corporation; Fuji Jukogyo Kabushiki Kaisha, both of Tokyo, Japan

[21] Appl. No.: 582,729

[22] Filed: Sep. 14, 1990

[30] Foreign Application Priority Data

Sep. 22, 1989 [JP] Japan ..... 1-110328[U]

[51] Int. Cl.[5] ..... H01R 13/639; H01R 29/00

[52] U.S. Cl. ..... 439/372; 439/188; 439/488; 200/51.09

[58] Field of Search ..... 439/372, 188, 911, 923, 439/488–490, 509; 200/51.09–51.11, 308, 310, 318, 321, 322

[56] References Cited

U.S. PATENT DOCUMENTS

| | | | |
|---|---|---|---|
| 1,819,101 | 8/1931 | Kenerson | 200/51.1 |
| 4,674,814 | 6/1987 | Hoshino et al. | 439/372 |
| 4,850,888 | 7/1989 | Denlinger et al. | 439/188 |
| 4,871,325 | 10/1989 | Maejima et al. | 439/372 |
| 4,878,853 | 11/1989 | Yamade et al. | 439/372 |
| 4,904,196 | 2/1990 | Sueyoshi et al. | 439/188 |
| 4,906,203 | 3/1990 | Margrave et al. | 439/188 |
| 4,941,839 | 7/1990 | Nagasaka et al. | 439/489 |

FOREIGN PATENT DOCUMENTS

| | | |
|---|---|---|
| 3833120A1 | 4/1989 | Fed. Rep. of Germany . |
| 3839728A1 | 6/1989 | Fed. Rep. of Germany . |
| 2180657A | 4/1987 | United Kingdom . |

*Primary Examiner*—Paula A. Bradley
*Assistant Examiner*—Kevin J. Carroll
*Attorney, Agent, or Firm*—Armstrong, Nikaido, Marmelstein, Kubovcik & Murray

[57] ABSTRACT

A coupling confirming mechanism for an electric connector having a first and second connector housings, capable of confirming the proper coupling of the first and second connector housings and double-locking the first and second connector housings. The coupling confirming mechanism comprises: a locking arm having a locking projection formed on the first connector housing; a locking lever pivotally joined at its rear end to the first connector housing and provided at its front end with an insulating projection, and at its front end with locking fingers; locking projections formed on the second connector housing; a break contact formed of a pair of short-circuiting terminals disposed in a short-circuiting terminal chamber formed in the second connector housing. The locking fingers of the locking lever is able to engage the locking projections of the second connector housing and the insulating projection of the same is able to break the break contact only when the first and second connector housings are properly coupled. The first and second connector housings can be double-locked by the engagement of the locking projection of the locking arm and the second connector housing and by the engagement of the locking lever and the second connector housing only when the first and second connector housings are properly coupled.

3 Claims, 4 Drawing Sheets

PROPER COUPLING CONFIRMING MECHANISM FOR AN ELECTRIC CONNECTOR

BACKGROUND OF THE INVENTION

1. Field of the Invention

The present invention relates to a proper coupling confirming mechanism for an electric connector for connecting contactors of an electric circuit on a vehicle.

2. Description of the Prior Art

The electric connector has a pair of connector housings, which are mated together to join electrically the male and female contactors contained therein, and is provided with locking means including flexible locking arm and a locking arm catching member between the pair of connector housings to lock the pair of connector housings to each other. In manually coupling the pair of connector housings, the coupling and locking of the pair of connector housings are confirmed through the tactile recognition of coupling, the auditory recognition of locking sound and the visual inspection of the appearance of the electric connector. However, since a large number of electric connectors need to be coupled on the vehicle and the working environment is not necessarily favorable for the sensational confirmation of the coupling of the electric connectors, it is possible that some electric connectors are not properly coupled.

To reduce this problem, an electrically efficient coupling confirming mechanism as shown in FIGS. 6 and 7 is proposed in Japanese Utility Model Laid-open (Kokai) No. 61-186180. This coupling confirming mechanism comprises a pair of electrical contactors $b_1$ and $b_2$ contained in a first connector housing a in an electrically separate condition, and an elastic tongue e contained in a second connector housing d to force the pair of electrical contactors $b_1$ and $b_2$ into contact with each other. The first connector housing a is provided with a protrusion c which prevents connectors $b_1$ and $b_2$ from forcible contact when the first connector housing a and the second connector housing d are improperly coupled.

This coupling confirming mechanism, however, has the following drawbacks. As shown in FIG. 6, since the pair of electrical contactors $b_1$ and $b_2$ disposed close to each other in the first connector housing a and any insulating means is not provided between the pair of electrical contactors $b_1$ and $b_2$, it is possible that the electrical contactors $b_1$ and $b_2$ remain in contact with each other before the coupling of the first connector housing a and the second connector housing d when either the electrical contactor $b_1$ or $b_2$ or both the electrical contactors $b_1$ and $b_2$ are deformed or are disposed incorrectly within the first connector housing a. Furthermore, since the elastic tongue e is comparatively small and is formed of a synthetic resin integrally with the second connector housing d, the elasticity of the elastic tongue e is dependent on temperature and, under some conditions the elastic tongue e is unable to function properly, and the elastic tongue e makes the internal construction of the second connector housing d complex.

SUMMARY OF THE INVENTION

Accordingly, it is an object of the present invention to provide a coupling confirming mechanism for an electric connector having first and second connector housings, capable of detecting the improper coupling of the first and second connector housings and capable of securely double-locking the first and second connector housings.

In one aspect of the present invention, a coupling confirming mechanism is provided for an electric connector having a first connector housing provided on its wall with a locking arm, and a second connector housing provided with latching means for latching the locking arm when the first and second connector housings are properly coupled, locking the first and second connector housings to each other. The coupling confirming mechanism comprises a break contact consisting of a pair of short-circuiting terminals accommodated in a short-circuiting terminal chamber formed in the second connector housing, and a locking lever pivotally joined to the first connector housing. The locking lever is capable of engaging the second connector housing when the first and second connector housings are coupled, and is provided at its extremity with a breaking projection which enters the short-circuiting terminal chamber through an opening formed in the wall of the second connector housing to break the break contact when the first and second connector housings are properly coupled.

The locking arm of the first connector housing locks the first and second connector housings to each other for primary locking when the first and second connector housings are coupled, and the locking lever pivotally supported on the first connector housing is allowed to engage the second connector housing to lock the first and second connector housings for secondary locking and to break the break contact only when the first and second connector housings are coupled. Thus, the first and second connector housings are double-locked and the proper coupling of the first and second connector housings can be detected by electrically checking the condition of the break contact by a check circuit having an alarm lamp which is switched on when the first and second connector housings are coupled improperly.

If the first and second connector housings are coupled improperly, the locking lever is unable to engage the second connector housing, the break contact remains closed, and hence the alarm lamp remains switched on.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENT

Figure 1:
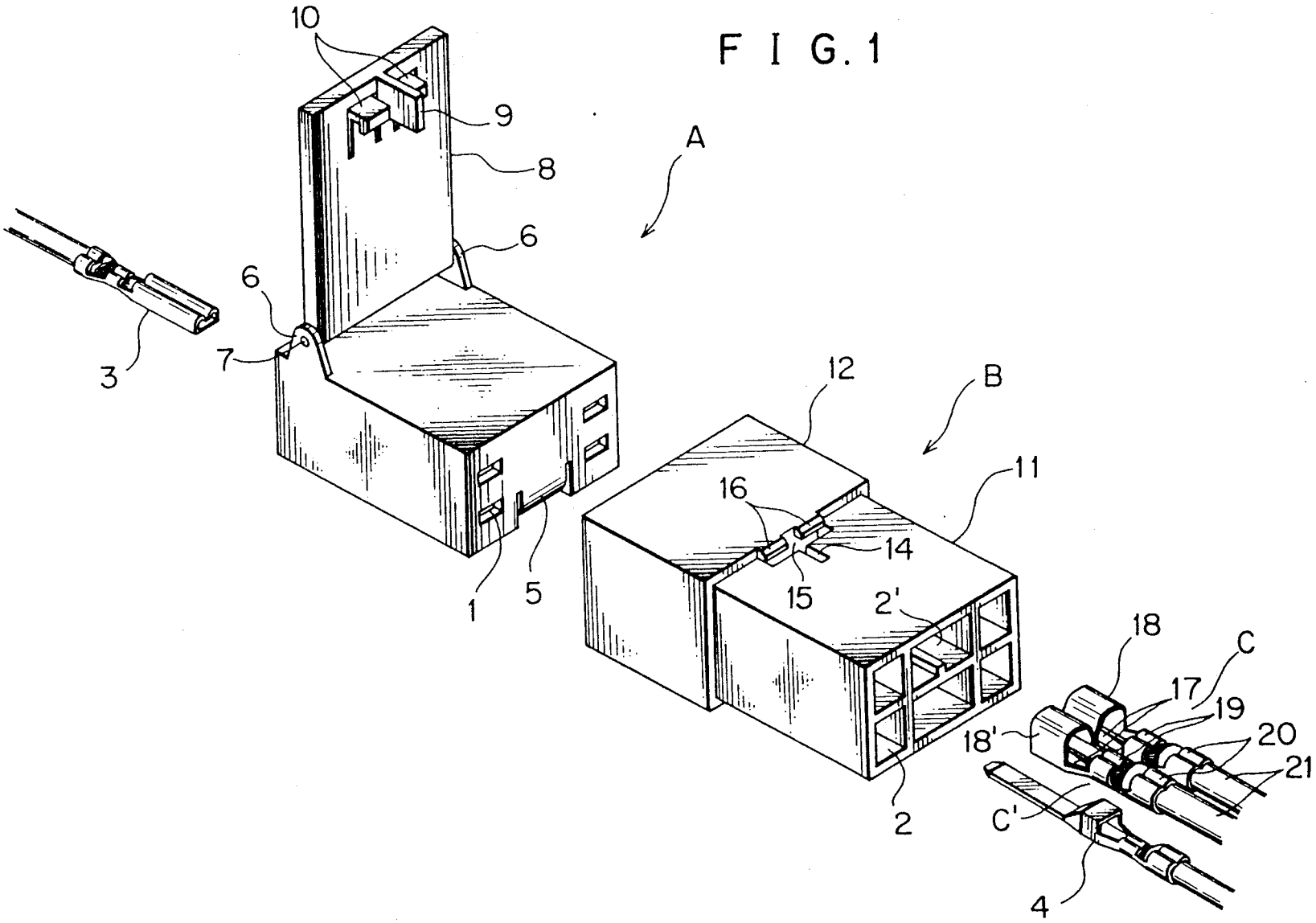
FIG. 1 is an exploded perspective view of a coupling confirming mechanism for an electric connector, in a preferred embodiment according to the present invention.
Figure 2:
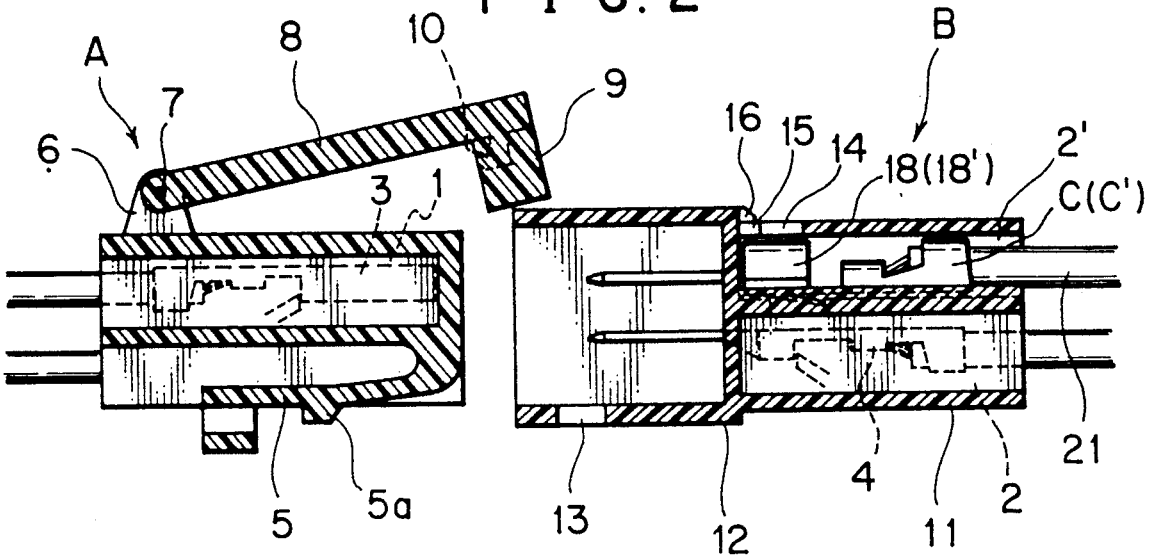
FIG. 2 is a longitudinal sectional view of the coupling confirming mechanism of FIG. 1.

Shown in FIGS. 1 and 2 are a first connector housing A formed of a synthetic resin and internally provided with a plurality of contactor chambers 1 accommodating female electrical contactors 3, respectively, a second connector housing B formed of a synthetic resin and internally provided with a plurality of contactor chambers 2 accommodating male electrical contactors 4, respectively, and a short-circuiting terminal chamber 2' accommodating a pair of short-circuiting terminals C and C'.

A flexible locking arm 5 having a locking projection 5*a* (FIG. 2) is formed in the lower wall of the first connector housing A. A locking lever 8 is pivotally supported at its rear end by a pin 7 on lugs 6 formed at the opposite sides of the rear end of the upper wall of the first connector housing A. The locking lever 8 is provided at the front end of the surface facing the upper surface of the first connector housing A with an insulating projection 9, and locking fingers 10 formed on the opposite sides of the insulating projection 9.

The second connector housing B has a connector body 11 having the contactor chambers 2 and the short-circuiting terminal chamber 2', and a hood 12 for receiving the first connector housing A, forming the front portion of the second connector housing B. An opening 13 for catching the locking projection 5*a* of the locking arm 5 is formed in the hood 12. The short-circuiting contactor chamber 2' is formed in the connector body 11. The short-circuiting terminals C and C' are the same in shape and are disposed symmetrically. The short-circuiting terminal C (C') has a base 17 (17), a curled, elastic contact tongue 18 (18') formed at the extremity of the base 17 (17), a crimp conductor fastener 19 (19) for fastening a conductor, formed in the rear portion of the base 17 (17), and a crimp cover fastener 20 (20) for fastening the insulation of the conductor, formed behind the crimp conductor fastener 19 (19). Cables 21 are fastened to the short-circuiting terminals C and C' by crimping.

A slot 14 is formed in the upper wall of the connector body 11 of the second connector housing B at a position corresponding to the joint of the contact tongues 18 and 18' of the short-circuiting terminals C and C' forming a break contact. Locking projections 16 which engage the locking fingers 10 of the locking lever 8 project from the rear edge of the hood 12 over an opening 15 merging into the slot 14.

The coupling confirming functions of the locking lever 8 and the short-circuiting terminals C and C' will be described hereinafter.

Figure 3:
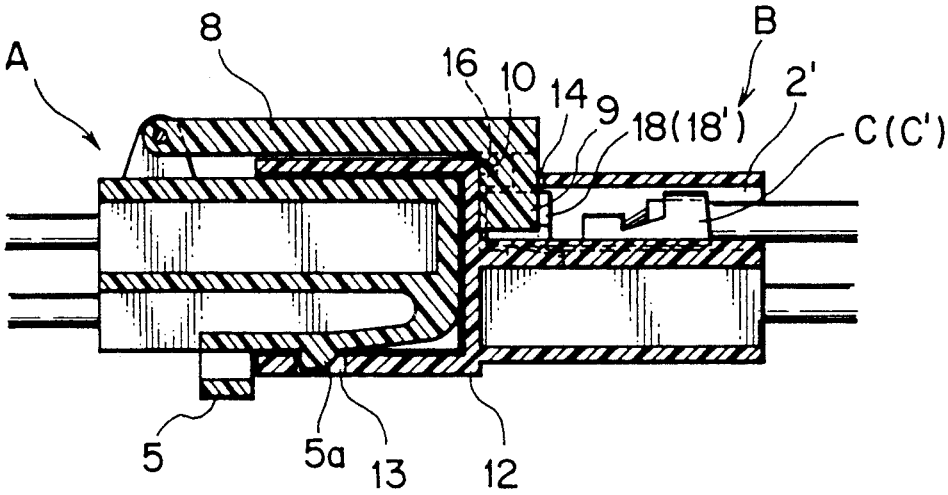
FIGS. 3 and 4 are longitudinal sectional views of the coupling confirming mechanism of FIG. 1 in a state where the electric connector is properly coupled and in a state where the same is improperly coupled, respectively.

The locking projection 5*a* of the locking arm 5 engages the opening 13 of the hood 12 to lock the first connector housing A and the second connector housing B to each other in a primary locked state when the first connector housing A and the second connector housing B are coupled as shown in FIG. 3. In this state, the locking lever 8 is brought into engagement with the second connector housing B. Then, the insulating projection 9 of the locking lever 8 enters the short-circuiting terminal chamber 2' through the slot 14 and into the joint of the pair of elastic contact tongues 18 and 18' of the short-circuiting terminals C and C' to disconnect the elastic contact tongues 18 and 18', thereby breaking contact. At the same time, the locking fingers 10 are caught by the locking projections 16 to lock the first connector housing A and the second connector housing B in a secondary locked state. Thus, the first connector housing A and the second connector housing B are double-locked.

Figure 4:
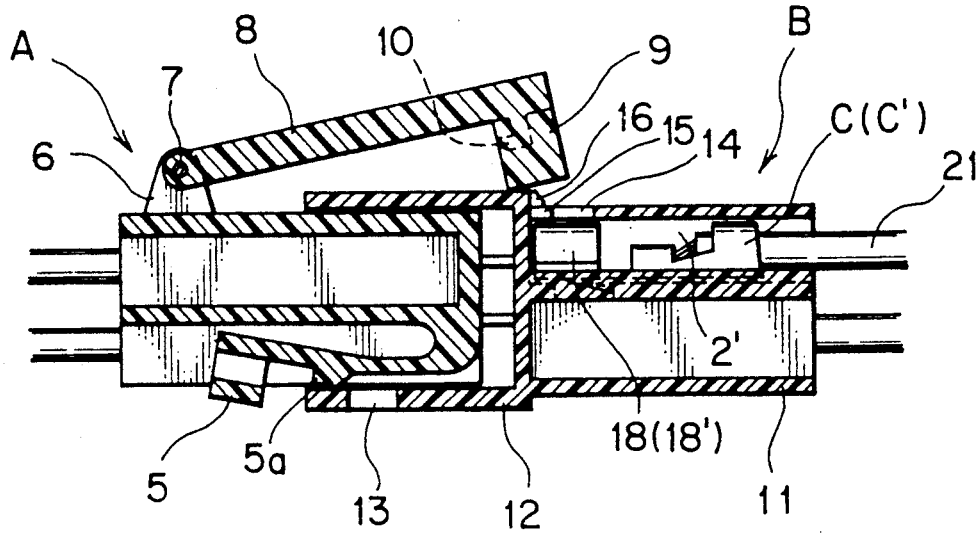

If the first connector housing A and the second connector housing B are improperly coupled as shown in FIG. 4, the insulating projection 9 of the locking lever 8 is unable to reach the slot 14, and hence the locking lever 8 is unable to perform a locking function and the elastic contact tongues 18 and 18' remain in contact with each other, namely, the break contact remains closed and the locking arm 5 is unable to engage the second connector housing B. In FIGS. 3 and 4, the female electrical contactors 3 and the male electrical contactors 4 are omitted for simplicity.

Figure 5A:
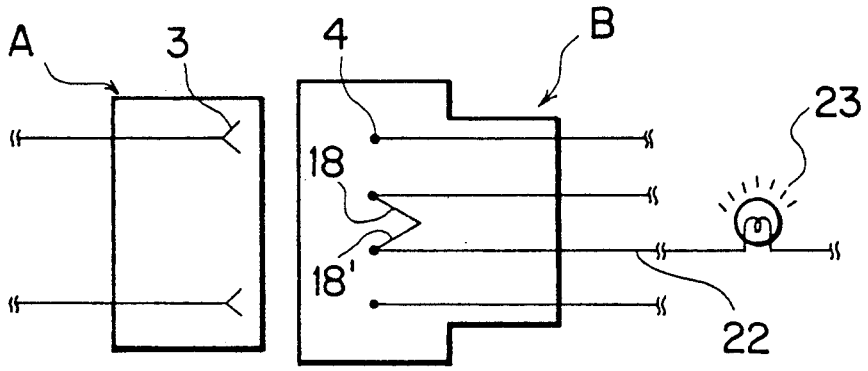
FIGS. 5A and 5B are circuit diagrams of a check circuit, showing the condition of the check circuit before and after the coupling of the electric connector.

FIG. 5A shows the condition of a check circuit 22 for confirming the proper coupling of the first connector housing A and the second connector housing B when the first connector housing A and the second connector housing B are not coupled or are improperly coupled. Since the elastic contact tongues 18 and 18' of the short-circuiting terminals C and C' are in contact with each other, namely, the break contact is closed, the check circuit is made to switch on an alarm lamp 23.

Figure 5B:
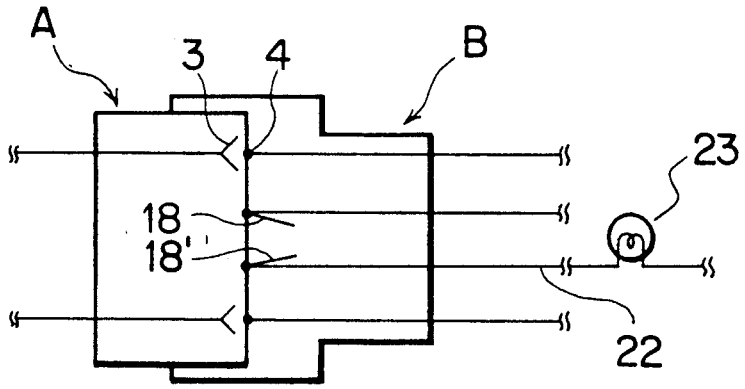
Figure 6:
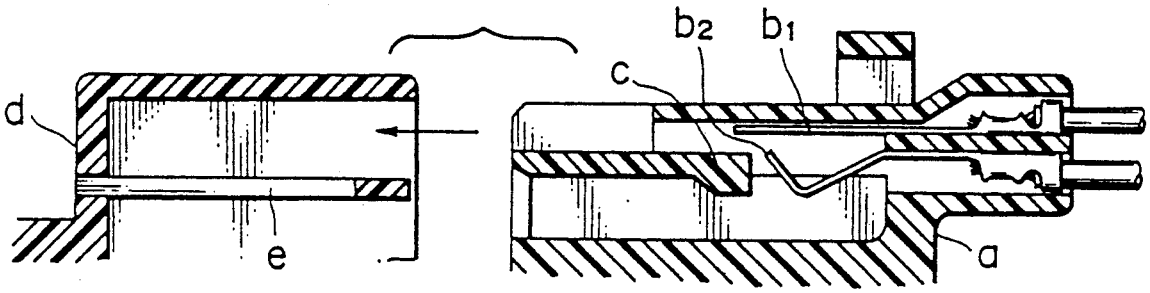
FIG. 6 PRIOR ART
FIG. 6 is an exploded sectional view of a conventional coupling confirming mechanism in a state where the electric connector is not coupled.
Figure 7:
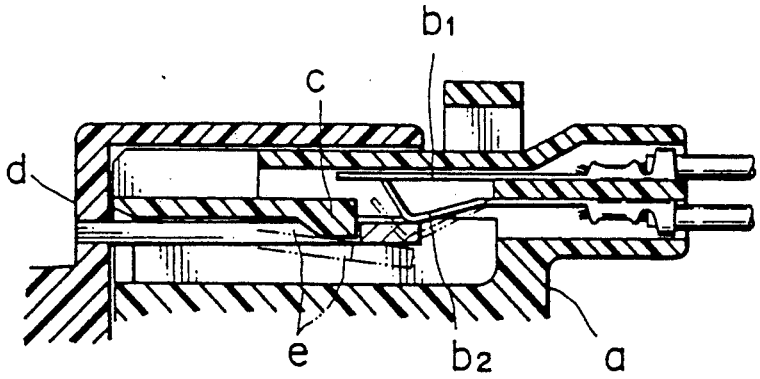
FIG. 7 PRIOR ART
FIG. 7 is a sectional view of the conventional coupling confirming mechanism in a state where the electric connector is coupled.

FIG. 5B shows the condition of the check circuit 22 when the first connector housing A and the second connector housing B are properly coupled. Since the elastic contact tongues 18 and 18' are disconnected from each other by the insulating projection 9, the check circuit 22 is broken and hence the alarm lamp 23 is switched off, which indicates that the first connector housing A and the second connector housing B are coupled and double-locked.

Accordingly, the proper coupling of the connector housings A and B can exactly be confirmed without depending on auditory, tactile and visual sensations.

The elastic tongues 18 and 18' are disconnected from each other only by the insulating projection 9 of the locking lever 8 and, normally, remains stably in contact with each other. Thus, the break contact formed by the short-circuiting terminals C and C' functions with a high reliability.

The locking lever 8 pivotally supported by the pin 7 on the first connector housing A may be formed integrally with the first connector housing A and hinged to the first connector housing A. The locking fingers 10 may be formed apart from the insulating projection 9, for example, on the opposite sides of the front edge of the locking lever 8, and the locking projections 16 may be formed on the opposite side walls of the connector body 11 or the hood 12 at positions respectively corresponding to the locking fingers 10. Such an arrangement of the locking fingers 10 and the locking projections 16 enables the omission of the opening 15. The locking lever 8 may be biased away from the second connector housing B with a spring, not shown, to prevent the locking lever 8 from falling naturally onto the second connector housing B.

Although the invention has been described in its preferred form with a certain degree of particularity, obviously many changes and variations are possible therein. It is therefore to be understood that the present invention may be practiced other than as specifically described herein without departing from the scope and spirit thereof.

What is claimed is:

1. A coupling confirming mechanism for an electric connector comprising a first connector housing and second connector housing, comprising:

first lock means provided between the first connector housing and the second connector housing for locking the first and second connector housings when assembled with each other;

second lock means including a locking lever which is pivotally attached to the first connector housing, for assuring the assembly of the first and second connector housings when said locking lever is pivoted onto said second connector housing;

a pair of short-circuiting terminals disposed in said second connector housing;

a normally closed contact formed between said pair of short-circuiting terminals; and an insulating projection formed on the locking lever and adapted to extend within said second connector housing when said locking lever is pivoted onto the second housing to open said normally closed contact and disconnect the pair of short-circuiting terminals from each other only when the first and second connector housings are properly coupled.

2. A coupling confirming mechanism as claimed in claim 1, wherein said locking lever has a finger formed thereon and engaging a slit formed in said second connector housing when said locking lever is pivoted onto said second connector housing.

3. A coupling confirming mechanism as claimed in claim 1, further comprising:

alarm means operatively connected to the pair of short-circuiting terminals for indicating improper coupling of the first and second connector housings when the normally closed contact is closed.

* * * * *